US006457957B1

(12) United States Patent
Bauer et al.

(10) Patent No.: US 6,457,957 B1
(45) Date of Patent: Oct. 1, 2002

(54) RADIAL PISTON PUMP FOR GENERATING HIGH FUEL PRESSURE

(76) Inventors: Ruediger Bauer, Turmhahnstr. 4/1, 74196 Neuenstadt (DE); Gerd Loesch, Gaensebergstr. 25, 70437 Stuttgart (DE)

( * ) Notice: Subject to any disclaimer, the term of this patent is extended or adjusted under 35 U.S.C. 154(b) by 0 days.

(21) Appl. No.: 09/807,407

(22) PCT Filed: Jun. 22, 1999

(86) PCT No.: PCT/DE99/01815

§ 371 (c)(1),
(2), (4) Date: May 11, 2001

(87) PCT Pub. No.: WO00/23711

PCT Pub. Date: Apr. 27, 2000

(30) Foreign Application Priority Data

Oct. 17, 1998 (DE) ..... 198 48 035

(51) Int. Cl.[7] ..... F04B 53/10

(52) U.S. Cl. ..... 417/562; 417/545; 417/549; 417/569

(58) Field of Search ..... 417/545, 549, 417/562, 569

(56) References Cited

U.S. PATENT DOCUMENTS

| | | | | | |
|---|---|---|---|---|---|
| 2,587,421 | A | * | 2/1952 | Willach | 137/524 |
| 3,543,682 | A | * | 12/1970 | Farrow | 101/151 |
| 3,912,421 | A | * | 10/1975 | Gelin | 417/273 |
| 4,923,373 | A | * | 5/1990 | Rothaar et al. | 417/300 |
| 5,358,383 | A | * | 10/1994 | Eisenbacher et al. | 417/273 |
| 5,984,651 | A | * | 11/1999 | Beck et al. | 137/112 |

* cited by examiner

*Primary Examiner*—Charles G. Freay
*Assistant Examiner*—Emmanuel Sayoc
(74) *Attorney, Agent, or Firm*—Ronald E. Greigg

(57) ABSTRACT

Disclosed is a radial piston pump having a longitudinally movable pump piston in a cylinder chamber which communicates with a suction valve. A closing body of the suction valve is loaded by a valve closing spring in the direction of its valve seat affixed to the housing. The valve closing spring is supported on the pump piston. The radial piston pump is especially useful in fuel injection systems of internal combustion engines, particularly in common rail injection systems.

4 Claims, 2 Drawing Sheets

11
18
19
21
16
17
15
20
22
11
10
12
13
14

RADIAL PISTON PUMP FOR GENERATING HIGH FUEL PRESSURE

CROSS-REFERENCE TO RELATED APPLICATIONS

This application is a 35 USC 371 application of PCT/DE 00/01815 filed on Jun. 22, 1999.

BACKGROUND OF THE INVENTION

1. Field of the Invention

The invention is radial piston engines;

2. Description of the Prior Art

A radial piston pump of this kind has been disclosed in DE 23 38 489 B2. In this known pump the suction valve has a shaft which leads from its closing body equaxially to the pump piston and supports the valve closing spring outside the cylinder chamber. This valve closing spring engages the shaft at one end and indirectly engages the pump housing at the other end. When the suction valve opens, the closing force of the spring therefore increases along with the stroke.

Radial piston pumps of this kind, which have a number of pump pistons (pump elements), must meet strict requirements with regard to uniform delivery: with a low supply quantity, all of the pump elements should be feeding and variation between the supply quantities of the individual pump elements should remain within strict limits. At a low pressure of the fuel supplied to the radial piston pump, difficulties in meeting these requirements arise, even with low opening pressure differences between the suction valves of the pump elements.

In the crown piston pump mentioned, the opening process of the suction valve should be assisted by virtue of the fact that the closing body of the valve disposed in the cylinder chamber, at the top dead center of the pump piston is largely encompassed by the pump piston and as a result, the piston exerts an aspirating action on the closing body during the intake stroke.

SUMMARY OF THE INVENTION

The radial piston pump according to the invention, has the advantage over the prior art that the opening of the suction valve is assisted at a low pressure of the supplied fuel by virtue of the fact that the closing force of the valve closing spring decreases as the intake stroke of the pump piston increases. In a multi-piston pump, an opening of all of the suction valves is thus reliably achieved and a relatively high degree of delivery uniformity is produced. As a result, an opening pressure adjustment of the suction valves can be eliminated or can be carried out with reduced precision.

DE 44 06 803 A1 has in fact disclosed a radial piston pump with a pump piston that is flowed through axially, in which a suction valve is disposed, whose valve closing spring engages the closing body of the suction valve at one end and engages the pump piston at the other end. When the suction valve opens, however, the closing force of the spring, increases along with the stroke.

Another feature of the invention permits the size of the radial piston pump to be reduced since the valve closing spring is disposed essentially inside the structural volume of the pump piston. This disposition simultaneously achieves a guidance of the valve closing spring.

Another feature enables sufficient guidance of the closing body shaft to be likewise achieved while simultaneously reducing the dead volume of the pump.

In a modification of the invention, direct introduction of the spring force into the components is used to control the valve. As a result, only the dimensional deviations of a few components affect the adjustment of the suction valve.

Other features and advantages of the invention will be apparent from the detailed description contained below, taken with the drawings, in which.

DESCRIPTION OF THE PREFERRED EMBODIMENT

Figure 1:
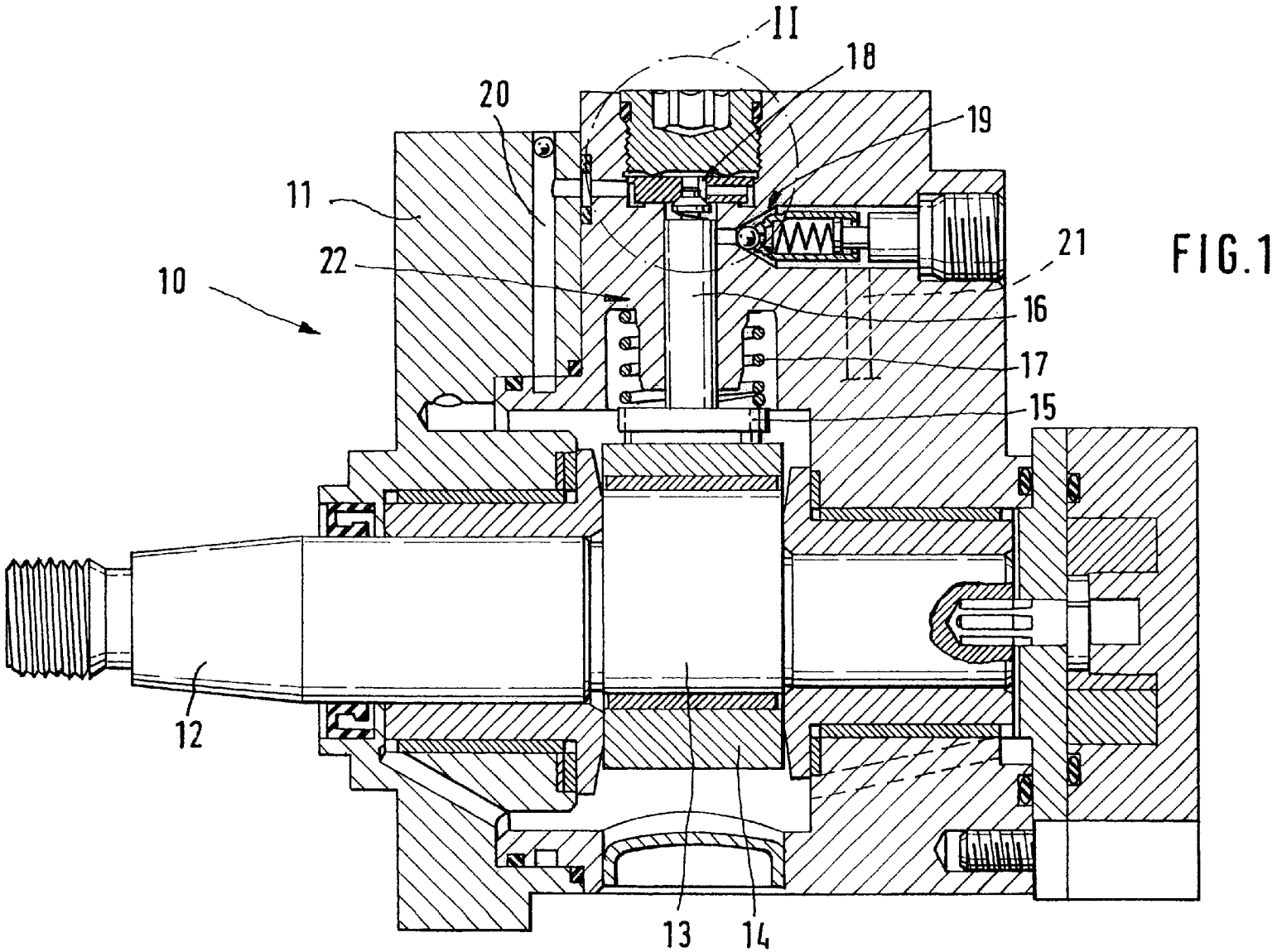
FIG. 1 is a sectional view of a radial piston pump.

A non-adjustable radial piston pump 10 shown in FIG. 1 is provided for generating high fuel pressure in fuel injection systems of internal combustion engines, in particular in a common rail injection system. The radial piston pump 10 has a housing 11 in which a drive shaft 12 with a cam section 13 is supported. A stroke ring 14 is guided on the cam section 13. In FIG. 1 of the drawings, the stroke ring 14 supports a piston base 15 of a pump piston 16 that is guided so that it can move longitudinally in the pump housing 11, radial to the drive shaft 12. Due to the action of a piston spring 17 disposed coaxial to the pump piston 16, which spring engages the piston base 15 at one end and the pump housing 11 at the other, the piston base 15 is kept in constant contact with the stroke ring 14. The pump piston 16 is also associated with a suction valve 18 and a pressure control valve 19. The suction valve 18 can be supplied with low-pressure fuel, for example diesel oil, by means of a conduit 20 of the pump housing 11. A conduit 21 of the pump housing 11 leads from the pressure control valve 19 and diverts high-pressure fuel delivered by the pump piston 16. The pump piston 16 with the piston base 15, piston spring 17, suction valve 18, and pressure control valve 19 constitutes a pump element 22 of the radial piston pump 10. This pump is equipped with additional pump elements 22, for example a total of three of them, which are disposed offset from one another by 120° (not visible in the drawing) in a plane radial to the axis of the drive shaft 12 in the pump housing 11. The additional pump elements 22 likewise communicate with the conduits 20 and 21. The subsequent description of the pump element 22 in conjunction with FIG. 2 consequently applies equally to the rest of the pump elements.

The suction valve 18 is disposed in the pump housing 11, radially behind the pump piston 16 in relation to the drive shaft 12. The suction valve has a valve plate 24, which is held down in a bore 25 of the pump housing 11 by a screw plug. A hollow, conical valve seat 27 is embodied on the valve plate 24. The valve seat 27 is consequently disposed so that it is fixed in relation to the housing and is connected in a communicating fashion to the conduit 20 that conveys low-pressure fuel. The suction valve 18 has a closing body 28 with a conical valve disk 29, which cooperates with the valve seat 27 of the valve plate 24. When the suction valve 18 is closed, the bottom of the valve disk 29 of the closing body 28 is approximately flush with the end face of the valve plate 24 oriented toward the pump piston.

Figure 2:
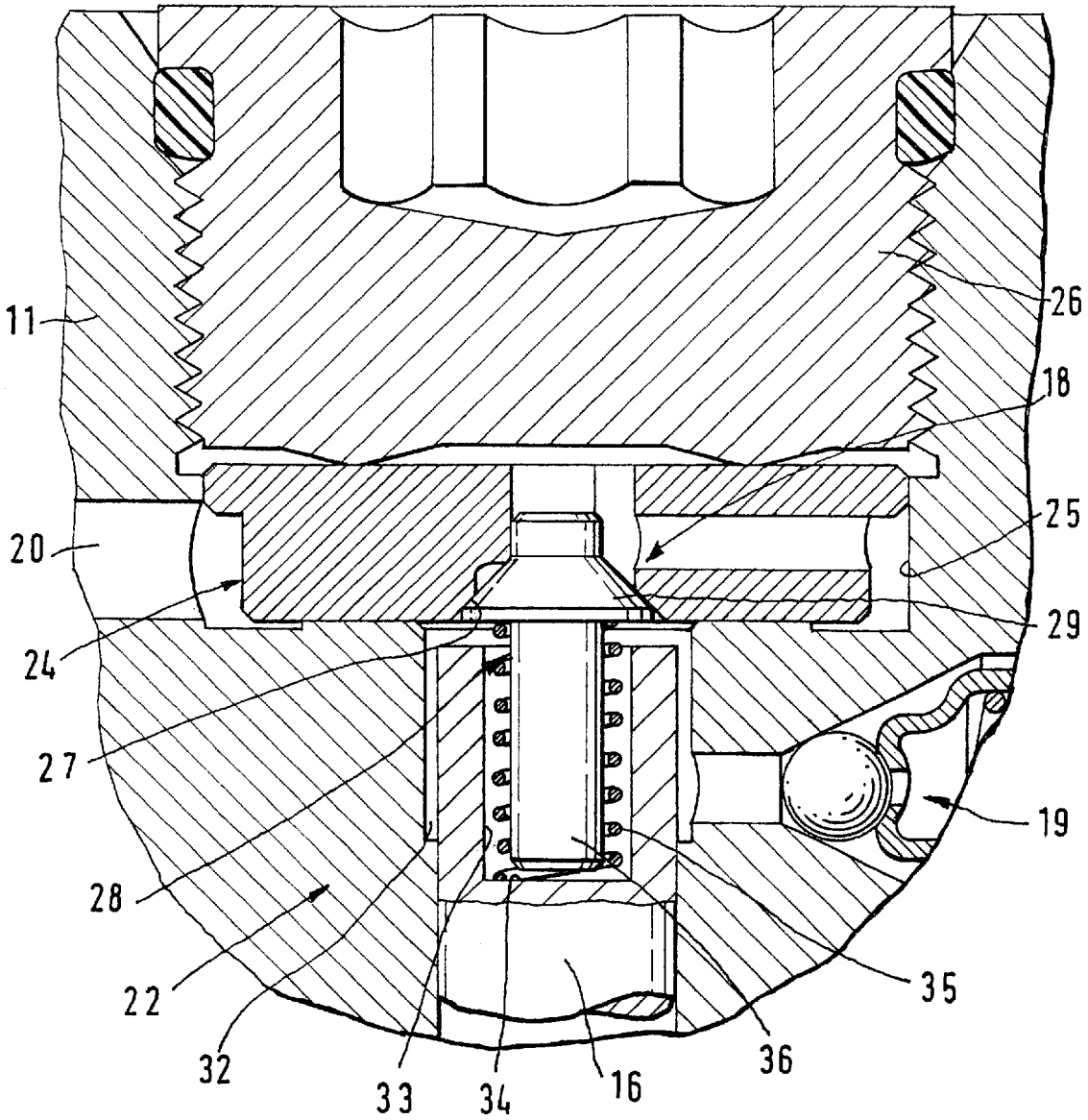
FIG. 2 shows an enlarged detail II from FIG. 1 of a suction valve of the pump.

The pump piston 16, which is disposed in a cylinder chamber (displacement chamber) 32 of the pump housing 11, has a longitudinal bore 33 embodied as a blind hole bore which fiends in a flat bore bottom 34. The longitudinal bore 33 is disposed coaxial to the pump piston 16 and contains a valve closing spring 35 embodied as a helical compression spring. Since the pump piston 16 when disposed in its top dead center shown in FIG. 2, extends close to the valve plate 24 adjoining the cylinder chamber 22, the valve closing spring 35 is disposed for the predominant part of its length in the longitudinal bore 33 of the pump piston. The valve closing spring 35 has an outer diameter that is largely adapted to the diameter of the longitudinal bore 33 of the pump piston 16 and engages the bore bottom 34 at one end and engages the valve disk 29 at the other end. The closing body 28 of the suction valve 18 is provided with a pin-shaped shaft 36, which is guided through the inside of the valve closing spring 35 and in the depicted dead center position of the pump piston 16 and closed position of the suction valve 18, reaches close to the bore bottom 34. The shaft 36 of the closing body 28, whose outer diameter corresponds almost to the inner diameter of the valve closing spring 35, extends slightly beyond the bottom of valve disk 29 and is guided so that it can move longitudinally in the valve plate 24. Since the shaft 36 of the closing body 28, which extends coaxial to the pump piston 16, together with the valve closing spring 35, largely fills up the volume of the longitudinal bore 33 of the pump piston 16, the dead volume of the pump is low, as shown in FIG. 2. As is also shown in FIG. 2, the cylinder chamber 32 oriented toward the suction valve is slightly enlarged diametrically in relation to the pump piston 16 and communicates with the pressure control valve 19 in this enlarged section.

In the depicted position of the pump piston 16, the valve closing spring 35 exerts a maximal closing force on the valve disk 29 of the suction valve 18 and keeps it closed. During the intake stroke of the pump piston 16, it is moved out of the depicted position toward the cam section 13 of the drive shaft 12. As a result, the valve closing spring 35 experiences a reduction in its closing force. The low-pressure fuel supplied to the suction valve 18 by the conduit 20 exerts an opening force on the valve disk 29 counter to the spring force. When the opening force prevails, the suction valve 18 is opened, i.e. the valve disk 29 lifts up from the valve seat 27 and moves into the cylinder chamber 32 by a slight amount. The opening of the suction valve 18 occurs as a function of the pressure of the fuel supplied: at a high pressure, the opening of the suction valve 18 occurs with even a small intake stroke of the pump piston 16; at a low pressure, the suction valve is opened when the pump piston 16 has traveled a larger intake stroke. The valve closing spring 35, however, is designed so that at low pressures of the supplied fuel, the suction valve 18 reliably opens with a large suction stroke of the pump piston 16 and a partial filling of the cylinder chamber 32 takes place. Because of the guaranteed opening of the suction valve 18, the partial filling of the remaining pump elements 22 of the radial piston pump 10 is also achieved in a corresponding manner.

The foregoing relates to preferred exemplary embodiments of the invention, it being understood that other variants and embodiments thereof are possible within the spirit and scope of the invention, the latter being defined by the appended claims.

We claim:

1. In a radial piston pump (10) for generating high fuel pressure in fuel injection systems of internal combustion engines, with a longitudinally movable, spring-loaded pump piston (16) in a cylinder chamber (32), which communicates with a suction valve (18) whose closing body (28) that opens at least indirectly into the cylinder chamber (32) is loaded by a valve closing spring (35) in the direction of its valve seat (27) affixed to the housing, the improvement wherein the valve closing spring (35) is supported against the pump piston (16) so that as the intake stroke of the pump piston increases, the closing force of the valve closing spring decreases.

2. The radial piston pump according to claim 1, wherein the valve closing spring (35) is embodied as a helical compression spring and is contained over the predominant part of its length in a longitudinal bore (33) of the pump piston (16).

3. The radial piston pump according to claim 2, wherein a pin-shaped shaft (36) of the closing body (28) is guided inside the valve closing spring (35).

4. The radial piston pump according to claim 3, wherein the valve closing spring (35) is supported with its one end at the bottom (34) of the longitudinal bore (33) of the pump piston (16), which is embodied as a blind hole bore, and is supported with its other end against a valve disk (29) of the closing body (28) of the suction valve (18), from which valve disk the pin-shaped shaft (36) of the closing body (28) extends.

* * * * *

UNITED STATES PATENT AND TRADEMARK OFFICE

CERTIFICATE OF CORRECTION

PATENT NO. : 6,457,957 B1
DATED : October 1, 2002
INVENTOR(S) : Ruediger Bauer et al.

It is certified that error appears in the above-identified patent and that said Letters Patent is hereby corrected as shown below:

Title page,
Please correct the following item [73] to read as follows:

-- [73] Assignee: Robert Bosch GmbH, Stuttgart (DE) --

Signed and Sealed this

Eleventh Day of November, 2003

JAMES E. ROGAN
*Director of the United States Patent and Trademark Office*